US011713557B2

(12) United States Patent
Fukuda et al.

(10) Patent No.: US 11,713,557 B2
(45) Date of Patent: Aug. 1, 2023

(54) HYDRAULIC SYSTEM FOR WORKING MACHINE AND CONTROL METHOD OF THE HYDRAULIC SYSTEM

(71) Applicant: KUBOTA CORPORATION, Osaka (JP)

(72) Inventors: Yuji Fukuda, Osaka (JP); Yusuke Tomatsu, Osaka (JP)

(73) Assignee: KUBOTA CORPORATION, Osaka (JP)

( * ) Notice: Subject to any disclaimer, the term of this patent is extended or adjusted under 35 U.S.C. 154(b) by 510 days.

(21) Appl. No.: 16/901,453

(22) Filed: Jun. 15, 2020

(65) Prior Publication Data

US 2021/0025126 A1 Jan. 28, 2021

(30) Foreign Application Priority Data

Jul. 26, 2019 (JP) ..... JP2019-137702

(51) Int. Cl.
*E02F 3/30* (2006.01)
*E02F 3/43* (2006.01)
(Continued)

(52) U.S. Cl.
CPC ..... *E02F 3/436* (2013.01); *E02F 3/30* (2013.01); *E02F 3/38* (2013.01); *E02F 3/425* (2013.01);
(Continued)

(58) Field of Classification Search
CPC . E02F 9/2267; E02F 3/42; E02F 3/432; E02F 9/2292; E02F 9/2228; E02F 3/433;
(Continued)

(56) References Cited

U.S. PATENT DOCUMENTS 4,612,716 A * 9/1986 Bulgarelli ..... E02F 9/2004 37/443
6,047,228 A * 4/2000 Stone ..... E02F 9/2025 701/50

(Continued)

FOREIGN PATENT DOCUMENTS

JP 2017 106485 A 6/2017
WO WO-9840570 A1 * 9/1998 ..... E02F 3/435

OTHER PUBLICATIONS

An abstract for "Valve Controlled Teleoperated Skid Steered Mobile Machine" by Jani M. Vilenius, Albert Raneda, Mika O. Hyvonen, Jarno R. A. Uusisalo, Kalevi J. Huhtala; IMECE2004-59257, pp. 157-164; 8 pages https://doi.org/10.1115/IMECE2004-59257 (Year: 2008).*

(Continued)

*Primary Examiner* — Cuong H Nguyen
(74) *Attorney, Agent, or Firm* — Greenblum & Bernstein, P.L.C.

(57) ABSTRACT

A hydraulic system includes: a boom cylinder to move a boom; a working tool cylinder to move a working tool attached to the boom; a boom control valve to control the boom cylinder; a working tool control valve to control the working tool cylinder; a horizontal control valve having: an activating position to allow a horizontalizing operation of the working tool; and a stopping position to stop the horizontalizing operation; and a controller device having: a first information obtaining portion to obtain permission and non-permission to the horizontalizing operation; a second information obtaining portion to obtain at least one of upward operation and upward movement of the boom; and a horizontal controller to set the horizontal control valve to the stopping position when the first information obtaining portion obtains the non-permission and the second informa- (Continued)

tion obtaining portion obtains one of the upward operation and the upward movement.

14 Claims, 9 Drawing Sheets

(51) Int. Cl.
*E02F 9/22* (2006.01)
*E02F 3/42* (2006.01)
*E02F 3/38* (2006.01)

(52) U.S. Cl.
CPC ..... *E02F 3/433* (2013.01); *E02F 9/2228* (2013.01); *E02F 9/2267* (2013.01)

(58) Field of Classification Search
CPC ..... E02F 3/425; E02F 3/30; E02F 3/38; E02F 3/436
USPC ..... 701/50; 60/413, 422; 172/2; 37/348
See application file for complete search history.

(56) References Cited

U.S. PATENT DOCUMENTS 6,108,948 A * 8/2000 Tozawa ..... E02F 3/435 37/348
6,185,493 B1 * 2/2001 Skinner ..... E02F 9/2033 701/50
6,434,437 B1 * 8/2002 Brandt ..... B66F 9/0655 700/63
6,951,067 B1 * 10/2005 Dietz ..... E02F 3/431 701/50
8,862,340 B2 * 10/2014 Andruch, III ..... E02F 9/265 701/2
2012/0251283 A1 * 10/2012 Violland ..... B66F 9/22 414/815
2014/0178166 A1 * 6/2014 Andruch, III ..... B66C 13/18 414/815
2014/0208734 A1 * 7/2014 Horii ..... E02F 9/2239 60/420
2019/0249390 A1 * 8/2019 Tomita ..... E02F 9/2217
2021/0025126 A1 * 1/2021 Fukuda ..... E02F 9/2267
2021/0123206 A1 * 4/2021 Fukuda ..... E02F 9/2282
2021/0222405 A1 * 7/2021 Velde ..... E02F 9/2033

OTHER PUBLICATIONS

"Analysis of the Position Recognition of the Bucket Tip According to the Motion Measurement Method of Excavator Boom, Stick and Bucket" by Dongik Sun et al.; Sensors 2020, 20(10), 2881; https://doi.org/10.3390/s20102881 (Year: 2020).*

D. Jud, G. Hottiger, P. Leemann and M. Hutter, "Planning and Control for Autonomous Excavation," in IEEE Robotics and Automation Letters, vol. 2, No. 4, pp. 2151-2158, Oct. 2017, doi: 10.1109/LRA.2017.2721551. (Year: 2017).*

S. Sang et al., "Technical Status and Development Trend of Double Arm Pipe Arranger for Offshore Drilling Platforms," 2022 4th Inter. Academic Exchange Conf, on Science and Technology Innovation (IAECST), Guangzhou, China, 2022, pp. 448-451, doi: 10.1109/IAECST57965.2022.10062220 (Year:2022).*

X. Mao, X. Li, Y. Huang, J. Shi and Y. Zhang, "Programmable Logic Controllers Past Linear Temporal Logic for Monitoring Applications in Industrial Control Systems," in IEEE Transactions on Industrial Informatics, vol. 18, No. 7, pp. 4393-4405, Jul. 2022, doi: 10.1109/TII.2021.3123194.(Year:2022).*

S. Lee et al. "Excavator Posture Estimation and Position Tracking System Based on Kinematics and Sensor Network to Control Mist-Spraying Robot," in IEEE Access, vol. 10, pp. 107949-107960, 2022, doi: 10.1109/ACCESS.2022.3212732 (Year:2022).*

* cited by examiner

HYDRAULIC SYSTEM FOR WORKING MACHINE AND CONTROL METHOD OF THE HYDRAULIC SYSTEM

CROSS-REFERENCE TO RELATED APPLICATIONS

The present application claims priority under 35 U.S.C. § 119 to Japanese Patent Application No. P2019-137702, filed Jul. 26, 2019. The content of this application is incorporated herein by reference in their entirety.

BACKGROUND OF THE INVENTION

Field of the Invention

The present invention relates to a hydraulic system for a working machine such as a skid steer loader and a compact track loader.

Description of Related Art

A hydraulic system of a working machine disclosed in Japanese Unexamined Patent Application Publication No. 2017-106485 is previously known. The working machine disclosed in Japanese Unexamined Patent Application Publication No. 2017-106485 includes a boom, a bucket, a boom cylinder configured to move the boom, a working tool cylinder configured to move the bucket, a first control valve configured to control stretching and shortening of the boom cylinder, and a second control valve configured to control stretching and shortening of the working tool cylinder. The operation fluid outputted from the pump is supplied to the first control valve and to the second control valve.

The hydraulic system disclosed in Japanese Unexamined Patent Application Publication No. 2017-106485 is a hydraulic system configured to perform horizontal movement of the bucket. In performing the horizontalizing operation of the bucket, the bucket can be horizontally operated by supplying, to the working tool cylinder, the operation fluid (return fluid) that returns to the first control valve when the boom is moved upward.

SUMMARY OF THE INVENTION

A hydraulic system for a working machine, includes: a boom cylinder to move a boom upward and downward; a working tool cylinder to move a working tool attached to the boom; a boom control valve to control the boom cylinder; a working tool control valve to control the working tool cylinder; a horizontal control valve having: an activating position to allow a horizontalizing operation of the working tool; and a stopping position to stop the horizontalizing operation; and a controller device having: a first information obtaining portion to obtain permission and non-permission to the horizontalizing operation of the horizontal control valve; a second information obtaining portion to obtain at least either one of upward operation of the boom and upward movement of the boom; and a horizontal controller to set the horizontal control valve to the stopping position when the first information obtaining portion obtains the non-permission and the second information obtaining portion obtains either one of the upward operation of the boom and the upward movement of the boom.

A control method of a hydraulic system for a working machine including: a boom cylinder to move a boom upward and downward; a working tool cylinder to move a working tool attached to the boom; a boom control valve to control the boom cylinder; a working tool control valve to control the working tool cylinder; a horizontal control valve having an activating position to allow a horizontalizing operation of the working tool and a stopping position to stop the horizontalizing operation; and a controller device to control the horizontal control valve, includes: obtaining permission and non-permission to a horizontalizing operation of the horizontal control valve; and setting the horizontal control valve to the stopping position upon obtaining either one of an upward operation of the boom and an upward movement of the boom under the non-permission to the horizontalizing operation.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
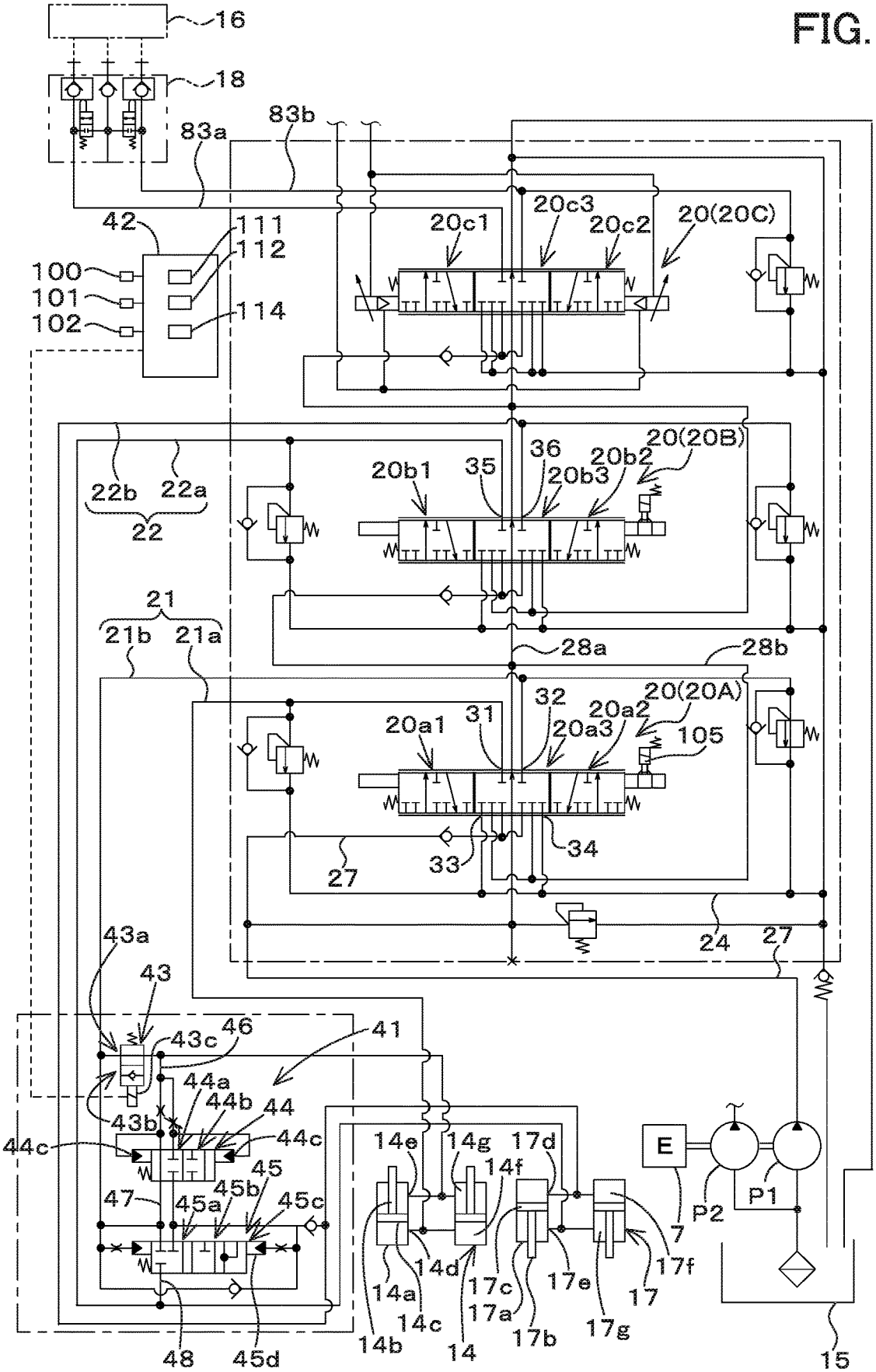
FIG. 1 is a view illustrating a hydraulic system (a hydraulic circuit) according to a first embodiment of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

First Embodiment

Figure 8:
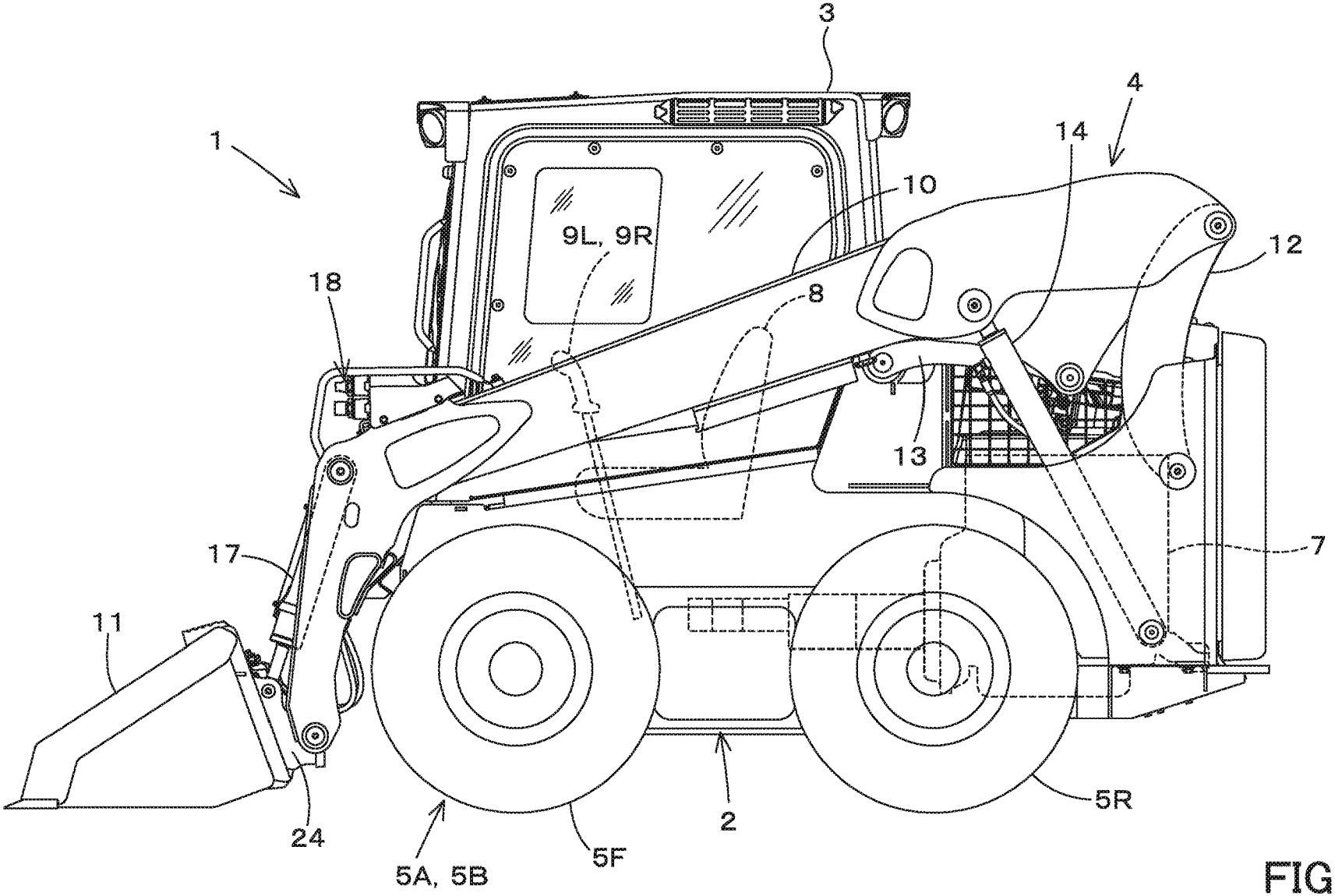
FIG. 8 is an overall view of a skid steer loader exemplified as a working machine according to the embodiments.

First, a configuration of a working machine will be described. FIG. 8 shows a side view of the working machine 1 according to a first embodiment of the present invention. FIG. 8 shows a skid steer loader as an example of the working machine 1. However, the working machine 1 according to the first embodiment is not limited to the skid steer loader, and may be another type of loader working machine such as a compact track loader. In addition, a working machine other than the loader working machine may be employed.

The working machine 1 includes a machine body (a vehicle body) 2, a cabin 3, a working device 4, a traveling device 5A, and a traveling device 5B.

A cabin 3 is mounted on the machine body 2. An operator seat 8 is provided inside at a rear portion of the cabin 3.

In the embodiment of the present invention, the front side of the operator sitting on the operator seat 8 of the working machine 1 (the left side in FIG. 8) is referred to as the front, the rear side of the operator (the right side in FIG. 8) is referred to as the rear, the left side of the operator (the front surface side of FIG. 8) is referred to as the left, and the right side of the operator (the back surface side of FIG. 8) is referred to as the right.

In addition, a horizontal direction that is a direction orthogonal to the front-rear direction will be described as a machine width direction. The direction extending from a center portion of the machine body 2 to the right portion or left portion thereof will be described as a machine outward direction. In other words, the machine outward direction is a direction separating away from the machine body 2, which is the machine width direction.

A direction opposite to the machine outward direction will be described as a machine inward direction. In other words, the machine inward direction is a direction approaching the machine body 2, which is the machine width direction.

The cabin 3 is mounted on the machine body 2. The working device 4 is a device configured to perform the working, and is mounted on the machine body 2. The traveling device 5A is a device configured to move the machine body 2, and is provided on the left side of the machine body 2.

The traveling device 5B is a device configured to travel the machine body 2, and is provided on the right side of the machine body 2. A prime mover 7 is provided inside at a rear portion of the machine body 2. The prime mover 7 is a diesel engine (an engine). The prime mover 7 is not limited to the engine, but may be an electric motor or the like.

A traveling lever 9L is arranged on the left side of the operator seat 8. A traveling lever 9R is arranged on the right side of the operator seat 8. The traveling lever 9L arranged to the left is provided for operating the traveling device 5A arranged to the left, and the traveling lever 9R arranged to the right is provided for operating the traveling device 5B arranged to the right.

The working device 4 includes a boom 10, a bucket 11, a lift link 12, a control link 13, a boom cylinder 14, and a working tool cylinder 17. The boom 10 is arranged on the side of the machine body 2.

The bucket 11 is provided at the tip end (the front end) of the boom 10. The lift link 12 and the control link 13 support the base portion (the rear portion) of the boom 10. The boom cylinder 14 drives the boom 10 up and down.

In particular, the lift link 12, the control link 13, and the boom cylinder 14 are arranged on the side of the machine body 2. The upper portion of the lift link 12 is pivotally supported by the upper portion of the base portion of the boom 10. The lower portion of the lift link 12 is pivotally supported on the side portion of the rear portion of the machine body 2.

The control link 13 is arranged in front of the lift link 12. One end of the control link 13 is pivotally supported by the lower portion of the base portion of the boom 10, and the other end is pivotally supported by the machine body 2.

The boom cylinder 14 is a hydraulic cylinder configured to move the boom 10 up and down. The upper portion of the boom cylinder 14 is pivotally supported by the front portion of the base portion of the boom 10. The lower portion of the boom cylinder 14 is pivotally supported by the side portion of the rear portion of the machine body 2. When the boom cylinder 14 is stretched and shortened, the boom 10 is swung up and down by the lift link 12 and the control link 13.

The working tool cylinder 17 is a hydraulic cylinder configured to swing the bucket 11. The working tool cylinder 17 connects between the left portion of the bucket 11 and the left boom, and connects between the right portion of the bucket 11 and the right boom.

In addition, instead of the bucket 11, a working tool such as a hydraulic crusher, a hydraulic breaker, an angle broom, an auger, a pallet fork, a sweeper, a mower, and a snow blower can be attached to the tip end (a front portion) of the boom 10.

In the present embodiment, each of the traveling devices 5A and 5B employs a wheel-type traveling device having a front wheel 5F and a rear wheel 5R. The traveling devices 5A and 5B may employ a crawler-type traveling device (including a semi-crawler-type traveling device).

Next, a working hydraulic circuit (a working hydraulic system) provided in the skid steer loader 1 will be described.

The working hydraulic system is a system configured to operate the boom 10, the bucket 11, an auxiliary attachment, and the like. As shown in FIG. 1, the working hydraulic system includes a plurality of control valves 20 and a working hydraulic pump P1 (a first hydraulic pump). In addition, the working hydraulic system includes a second hydraulic pump P2 different from the first hydraulic pump P1. Further, the working hydraulic system includes a tank (an operation fluid tank) 15 for storing operation fluid.

The first hydraulic pump P1 is a pump configured to be operated by the power of the prime mover 7, and is constituted of a constant displacement gear pump (a fixed displacement gear pump). The first hydraulic pump P1 is configured to output the operation fluid stored in the tank (an operation fluid tank) 15.

The second hydraulic pump P2 is a pump configured to be operated by the power of the prime mover 7, and is constituted of a constant displacement gear pump(a fixed displacement gear pump). The second hydraulic pump P2 is configured to output the operation fluid stored in the tank (the operation fluid tank) 15.

In the hydraulic system, the second hydraulic pump P2 outputs a signal operation fluid and a control operation fluid. The signal oil and the control oil both are referred to as a pilot fluid.

The plurality of control valves 20 are valves configured to control various types of hydraulic actuators provided in the working machine 1. The hydraulic actuator is a device configured to be operated by the operation fluid, and is a hydraulic cylinder, a hydraulic motor, or the like. In the embodiment, the plurality of control valves 20 includes a boom control valve 20A, a working tool control valve 20B, and an auxiliary control valve 20C.

The boom control valve 20A is a valve configured to control the boom cylinder 14 for operating the boom 10. The boom control valve 20A is a direct-acting spool type three-position switching valve. The boom control valve 20A switches between a neutral position 20*a*3, a first position 20*a*1 different from the neutral position 20*a*3, and a second position 20*a*2 different from the neutral position 20*a*3 and the first position 20*a*1. In the boom control valve 20A, the switching between the neutral position 20*a*3, the first position 20*a*1, and the second position 20*a*2 is performed by moving the spool through operation of the operation member 105.

The switching of the boom control valve 20A is performed by directly moving the spool through manual operation of the operation member 105. However, the spool may be moved through a hydraulic operation (a hydraulic operation by a pilot valve, a hydraulic operation by a proportional valve) or through an electric operation (an electric operation by magnetizing a solenoid), or may be moved through another method.

The boom control valve 20A and the first hydraulic pump P1 are connected by a output fluid tube 27. The operation fluid outputted from the first hydraulic pump P1 flows through the output fluid tube 27 and is supplied to the boom control valve 20A. The boom control valve 20A and the boom cylinder 14 are connected by a first fluid tube 21.

In particular, the boom cylinder 14 includes a cylinder body 14*a*, a piston 14*c* provided in the cylinder body 14*a* so as to be movable in the axial direction, and a rod 14*b* connected to the piston 14*c*. The piston 14*c* partitions the inside of the cylinder body (a cylinder tube) 14*a* into a first fluid chamber 14*f* and a second fluid chamber 14*g*. The first fluid chamber 14*f* is an fluid chamber provided on the bottom side (the side opposite to the rod 14*b* side) of the cylindrical body 14*a*. The second fluid chamber 14*g* is a fluid chamber provided on the rod side of the cylinder body 14*a*.

A first port 14*d*, which is a port for supplying and discharging the operation fluid and communicating with the first fluid chamber 14*f*, is provided at a base end portion (the side opposite to the rod 14*b* side) of the cylindrical body 14*a*. A second port 14*e*, which is a port for supplying and discharging the operation fluid and communicating with the second fluid chamber 14*g*, is provided at the tip end of the cylindrical body 14*a* (on the rod 14*b* side).

The first fluid tube 21 includes a first supply tube 21*a* connecting the first port 31 of the boom control valve 20A to the first port 14*d*, and includes a second supply tube 21*b* connecting the second port 32 of the boom control valve 20A to the second port 14*e*.

Thus, when the boom control valve 20A is set to the first position 20*a*1, the operation fluid can be supplied from the first supply tube 21*a* to the first port 14*d* (the first fluid chamber 14*f*) of the boom cylinder 14, and the operation fluid can be discharged from the second port 14*e* (the second fluid chamber 14*g*) of the boom cylinder 14 to the second supply tube 21*b*. In this manner, the boom cylinder 14 is stretched, and thereby the boom 10 is moved upward.

When the boom control valve 20A is set to the second position 20*a*2, the operation fluid can be supplied from the second supply tube 21*b* to the second port 14*e* (the second fluid chamber 14*g*) of the boom cylinder 14, and the operation fluid can be discharged from the first port 14*d* (the first fluid chamber 14*f*) of the boom cylinder 14 to the first supply tube 21*a*. In this manner, the boom cylinder 14 is shortened, and thereby the boom 10 is moved downward.

In addition, the boom control valve 20A includes a first discharge port 33 and a second discharge port 34. The first discharge port 33 and the second discharge port 34 are connected to a discharge fluid tube 24 connected to the operation fluid tank 15.

The working tool control valve 20B is a valve configured to control a hydraulic actuator (a working tool cylinder) 17 for operating the bucket 11. The working tool control valve 20B is a direct-acting spool type three-position switching valve. The working tool control valve 20B switches between a neutral position 20*b*3, a first position 20*b*1 different from the neutral position 20*b*3, and a second position 20*b*2 different from the first position 20*b*1 and the neutral position 20*b*3.

In the working tool control valve 20B, the switching between the neutral position 20*b*3, the first position 20*b*1, and the second position 20*b*2 is performed by moving a spool through operation of the operation member. In addition, the switching of the working tool control valve 20B is performed by directly moving the spool through manual operation of the operation member. However, the spool may be moved through a hydraulic operation (a hydraulic operation by a pilot valve, a hydraulic operation by a proportional valve) or through an electric operation (an electric operation by magnetizing a solenoid), or may be moved through another method.

The working tool control valve 20B and the boom control valve 20A are connected by a first supplying-discharging fluid tube 28*a* and a second supplying-discharging fluid tube 28*b*. When the boom control valve 20A is set to the neutral position 20*a*3, the operation fluid is supplied to the working tool control valve 20B through the first supplying-discharging fluid tube 28*a*. In addition, when the boom control valve 20A is set to the first position 20*a*1 or to the second position 20*a*2, the operation fluid is supplied to the working tool control valve 20B through the second supplying-discharging fluid tube 28*b*.

The working tool control valve 20B and the working tool cylinder 17 are connected by a second fluid tube 22. In particular, the working tool cylinder 17 includes a cylinder body 17*a*, a piston 17*c* provided in the cylinder body 17*a* so as to be movable in the axial direction, and a rod 17*b* connected to the piston 17*c*. The piston 17*c* partitions the inside of the cylinder body (a cylinder tube) 17*a* into a first fluid chamber 17*f* and a second fluid chamber 17*g*.

The first fluid chamber 17*f* is an fluid chamber arranged on the bottom side of the cylindrical body 17*a* (on the side opposite to the rod 17*b* side). The second fluid chamber 17*g* is an fluid chamber arranged on the rod side of the cylinder body 17*a*. A first port 17*d*, which is a port for supplying and discharging the operation fluid and communicating with the first fluid chamber 17*f*, is provided at a base end portion of the cylindrical body 17*a* (the side opposite to the rod 17*b* side). A second port 17*e*, which is a port for supplying and discharging the operation fluid and communicating with the second fluid chamber 17*g*, is provided at the tip end of the cylindrical body 17*a* (on the side of the rod 17*b*).

The second fluid tube 22 includes a first supply tube 22*a* connecting the second port 17*e* and the first port 35 of the working tool control valve 20B, and includes a second supply tube 22*b* connecting the first port 17*d* and the second port 36 of the working tool control valve 20B.

Thus, when the working tool control valve 20B is set to the first position 20*b*1, the operation fluid can be supplied from the first supply tube 22*a* to the second port 17*e* of the working tool cylinder 17 (the second fluid chamber 17*g*), and the operation fluid can be discharged, to the second supply tube 22*b*, from the first port 17*d* of the working tool cylinder 17 (the first fluid chamber 17*f*).

As the result, the working tool cylinder 17 is shortened, and thereby the bucket 11 performs a squeezing operation. When the boom control valve 20A is set to the second position 20*a*2, the operation fluid can be supplied from the second supply tube 22*b* to the first port 17*d* of the working tool cylinder 17 (the first fluid chamber 17*f*), and the operation fluid can be outputted from the second port 17*e* of the working tool cylinder 17 (the second fluid chamber 17*g*)

to the first supply tube 22*a*. In this manner, the working tool cylinder 17 is stretched, thereby performing a dumping operation.

The auxiliary control valve 20C is a valve configured to control a hydraulic actuator (a hydraulic cylinder, a hydraulic motor, or the like) 16 mounted on the auxiliary attachment. The auxiliary control valve 20C is a direct-acting spool type three-position switching valve to be operated by the pilot fluid. The auxiliary control valve 20C switches between a neutral position 20*c*3, a first position 20*c*1 different from the neutral position 20*c*3, and a second position 20*c*2 different from the neutral position 20*c*3 and the first position 20*c*1.

In the auxiliary control valve 20C, the switching between the neutral position 20*c*3, the first position 20*c*1, and the second position 20*c*2 is performed by moving the spool with the pressure of the pilot fluid. The connector member 18 is connected to the auxiliary control valve 20C by supplying-discharging fluid tubes 83*a* and 83*b*. The connector member 18 is connected to an fluid tube connected to the hydraulic actuator 16 of the auxiliary attachment.

Thus, when the auxiliary control valve 20C is set to the first position 20*c*1, the operation fluid can be supplied from the supplying-discharging fluid tube 83*a* to the hydraulic actuator 16 of the auxiliary attachment. When the auxiliary control valve 20C is set to the second position 20*c*2, the operation fluid can be supplied from the supplying-discharging fluid tube 83*b* to the hydraulic actuator 16 of the auxiliary attachment.

In this manner, by supplying the operation fluid from the supplying-discharging fluid tube 83*a* or the supplying-discharging fluid tube 83*b* to the hydraulic actuator 16, the hydraulic actuator 16 (the auxiliary attachment) can be operated.

As shown in FIG. 1, the hydraulic system includes a horizontal control valve 41 and a controller device 42.

The horizontal control valve 41 is a horizontal control valve configured to perform a horizontalizing operation (other operations) of the working tool cylinder 17. The horizontal control valve 41 includes a switching valve 43, a first control valve 44, and a second control valve 45.

The switching valve 43 is a valve configured to changes between a state in which the horizontalizing operation is stopped and a state in which the horizontalizing operation is activated. In particular, the switching valve 43 is a valve (an on-off valve) for switching the horizontalizing operation, and is, for example, a two-position switching valve configured to be switched between a stopping position 43*a* for stopping the horizontalizing operation and an activating position 43*b* for operating the horizontalizing operation.

Note that the switching valve 43 does not have to be a switching valve, and may be a proportional valve or another type of valve. In the present embodiment, the switching valve 43 is an electromagnetic switching valve configured to be switched to the stopping position 43*a* by a spring and to be switched to the activating position 43*b* by magnetizing a solenoid 43*c*.

The switching valve 43 is provided in the middle portion of the first fluid tube 21 (the second supply tube 21*b*). When the switching valve 43 is set to the stopping position 43*a*, the switching valve 43 allows the operation fluid to flow returning from the boom cylinder 14 to the boom control valve 20A and allows the operation fluid to flow from the boom control valve 20A toward the boom cylinder 14 in the first fluid tube 21 (the second supply tube 21*b*).

That is, the switching valve 43 opens the middle portion of the first fluid tube 21 (the second supply tube 21*b*) when the switching valve 43 is set to the stopping position 43*a*, and thereby allows the operation fluid to flow between the boom cylinder 14 side and the boom control valve 20A side. When the switching valve 43 is set at the stopping position 43*a*, the horizontalizing operation is not performed.

When the switching valve 43 is set to the activating position 43*b*, the switching valve 43 blocks the operation fluid (the return fluid) from flowing from the boom cylinder 14 toward the boom control valve 20A in the first fluid tube 21 (the second supply tube 21*b*), and allows the operation fluid to flow from the boom control valve 20A toward the boom cylinder 14. When the switching valve 43 is set to the activating position 43*b*, the horizontalizing operation is on (the horizontalizing operation is possible).

The first control valve 44 is a pilot-switching type two-position switching valve configured to switch between a first position 44*a* and a second position 44*b*. The first control valve 44 is connected to the first fluid tube 21 (the second supply tube 21*b*) by the first flow line 46 on the downstream side of the first control valve 44 and the switching valve 43 (on the boom cylinder 14 side). The pressure of the operation fluid in the first flow line 46 is applied to the pressure receiving portion 44*c* of the first control valve 44.

The second control valve 45 is a pilot-switching type three-position switching valve configured to switch between a first position 45*a*, a second position 45*b*, and a third position 45*c*. The first control valve 44 and the second control valve 45 are connected by a second flow line 47, and the pressure of the operation fluid in the second flow line 47 is applied to the pressure receiving portion 45*d* of the second control valve 45.

In addition, the second flow line 47 is the first fluid tube 21 (the second supply tube 21*b*) and is connected to the upstream side of the switching valve 43 (to the boom control valve 20A side). Further, the second control valve 45 and the second fluid tube 22 (the first supply tube 22*a*) are connected by a third flow line 48.

Thus, when set to the stopping position 43*a* (when the horizontalizing operation is off), the boom cylinder 14 can be stretched and shortened through the switching of the boom control valve 20A, and the working tool cylinder 17 can be stretched and shortened through the switching of the working tool control valve 20B. When set to the activating position 43*b* is set (when the horizontalizing operation is ON), the return fluid from the boom cylinder 14 (referred to as a boom return fluid) is shut off by the switching valve 43 in stretching the boom cylinder 14, that is, in moving the boom 10 upward.

The boom return fluid is applied to the pressure receiving portion 44*c* of the first control valve 44, and is applied to the pressure receiving portion 45*d* of the second control valve 45. Then, when the first control valve 44 and the second control valve 45 are switched, the boom return fluid is applied to the second fluid tube 22 (the first supply tube 22*a*) through the third flow line 48. As the result, the boom return fluid causes the working tool cylinder 17 to dump, that is, the working tool cylinder 17 performs the horizontalizing operation.

The controller device 42 is a device configured to perform the various controls, and is capable of controlling, for example, the prime mover 7, the horizontal control valve 41, and the like. A start switch 100, a first switch 101, and a state detector device 102 are connected to the controller device 42. The start switch 100 is a switch for starting the prime mover 7, and is, for example, a key switch. When the start switch 100 is switched to the ON position, the controller device 42 starts the prime mover 7.

When the start switch 100 is switched to the OFF position, the controller device 42 stops the prime mover 7. In addition, when the start switch 100 is switched to the ACC position, electric power is supplied to the equipment provided in the working machine 1 with the prime mover 7 stopped. When the start switch 100 is switched to either the ON position or the ACC position, the controller device 42 starts. That is, the start switch 100 is also a switch for instructing at least activation of the controller device 42.

The first switch 101 is, for example, a switch configured to be switched between ON and OFF, and is installed around the operator seat 8. The switching of the first switch 101 between ON and OFF can be manually switched by the operator. When the first switch 101 is switched to the ON position, the controller device 42 is instructed to allow the horizontalizing operation, and when the first switch 101 is switched to the OFF position, the controller device 42 is instructed to disallow the horizontalizing operation.

The state detector device 102 is a device configured to detect at least one of the operation and the movement regarding the upward movement of the boom 10 (an upward operation of the boom and an upward movement of the boom). The state detector device 102 includes a boom detector device configured to detect whether the boom 10 is moved upward or moved downward. The boom detector device includes, for example, a lever sensor configured to detect the swinging of the operation lever for operating the boom 10, an angle detector sensor configured to detect an angle of the boom 10 with respect to the machine body 2, a stretching-shortening detector sensor configured to detect the stretching and the shortening of the boom cylinder 14, and a pressure sensor configured to detect the upward movement and the downward moving of the boom 10 on the basis of the fluid pressure.

When the boom detector device is the lever sensor, the operation of upward movement of the boom 10 is detected when the operation lever is operated in the direction in which the boom 10 is moved upward. In addition, in the case where the boom detector device is a lever sensor, it may be detected that the operation of downward moving of the boom 10 has been performed when the operation lever is operated in the direction in which the boom 10 is moved downward.

In the case where the boom detector device is the angle detector sensor, the operation of upward movement of the boom 10 is detected when the opening angle between the machine body 2 and the base portion of the boom 10 (the angle of the boom 10) gradually increases. In the case where the boom detector device is the angle detector sensor, the angle detector sensor may detect that the operation of downward moving of the boom 10 has been performed when the opening angle (the angle of the boom 10) gradually decreases.

In the case where the boom detector device is the stretching-shortening detector sensor, the operation of upward movement of the boom 10 is detected when the boom cylinder 14 is stretched. In the case where the boom detector device is the stretching-shortening detector sensor, it may be detected that the operation of downward moving of the boom 10 has been performed when the boom cylinder 14 is shortened.

Figure 7:
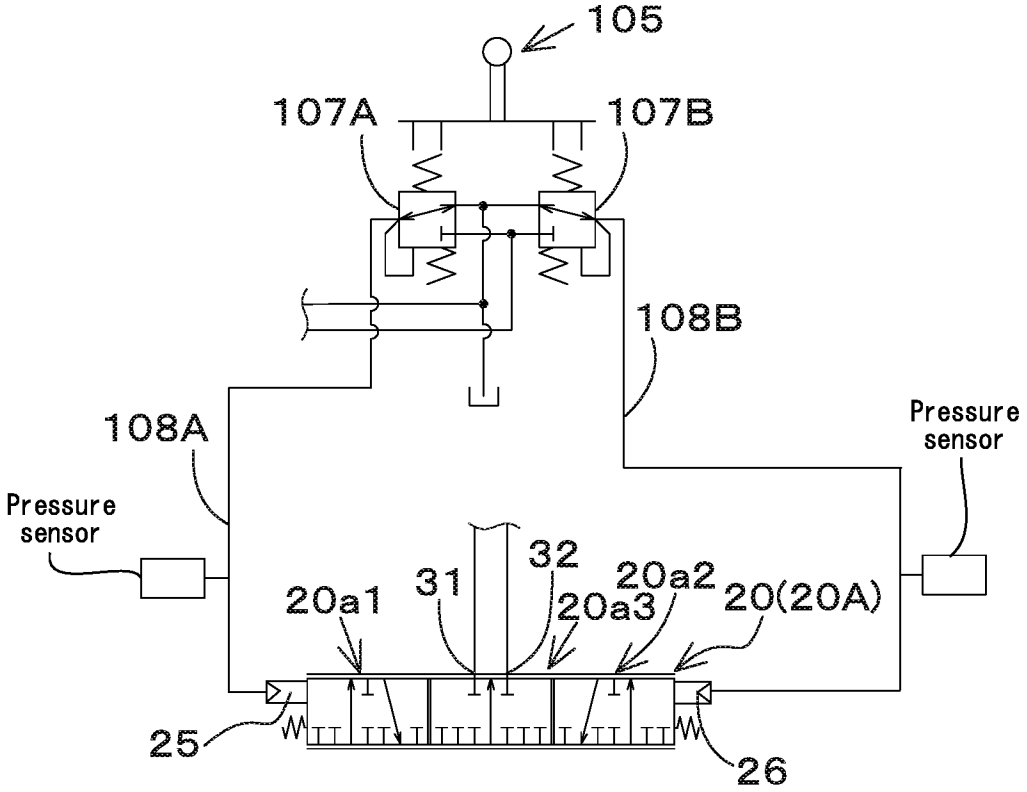
FIG. 7 is a view explaining a pressure receiving portion of a boom control valve according to the embodiments.

As shown in FIG. 7, when the boom detector device is a pressure sensor, the upward movement of the boom 10 is detected based on the changing of pressure in the fluid tube 108A connecting the pressure receiving portion 25 of the boom control valve 20A to the operation valve 107A configured to change the pressure (the pilot pressure) of the operation fluid in accordance with the operation of the operation member 105, and the operation of upward movement of the boom 10 is detected based on the changing of pressure in the first supply tube 21*a*.

In addition, when the boom detector device is a pressure sensor, the downward moving of the boom 10 may be detected based on the changing of pressure in the fluid tube 108B connecting the pressure receiving portion 25 of the boom control valve 20A to the operation valve 107B configured to change the pressure (the pilot pressure) of the operation fluid in accordance with the operation of the operation member 105, and the operation of upward movement of the boom 10 may be detected based on the changing of pressure in the second supply tube 21*b*.

Note that the pressure sensor may detect the upward operation or the downward-moving operation of the boom 10 by detecting a pressure generated when the spool of the boom control valve 20A is activated.

The controller device 42 includes a first information obtaining portion 111, a second information obtaining portion 112, and a horizontal controller portion 114. The first information obtaining portion 111, the second information obtaining portion 112, and the horizontal controller portion 114 are constituted of an electric/electronic circuit provided in the controller device 42 or of a computer program stored in the controller device 42, or the like.

The first information obtaining portion 111 obtains permission or non-permission to the horizontalizing operation of the horizontal control valve. For example, when a signal indicating that the first switch 101 is ON is inputted to the controller device 42, the first information obtaining portion 111 obtains the permission to the horizontalizing operation, and when a signal indicating that the first switch 101 is OFF is inputted to the controller device 42, the first information obtaining portion 111 obtains the non-permission to the horizontalizing operation.

The second information obtaining portion 112 can obtain information at least relating to the upward movement of the boom 10 (the upward operation, the upward movement). Note that the second information obtaining portion 112 may be configured to obtain information on the downward-moving of the boom 10 (the downward-moving operation, the downward-moving).

For example, when any one of the upward operation of and the upward movement of the boom 10 detected by the boom detector device is inputted to the controller device 42, the second information obtaining portion 112 obtains at least any one of the inputted upward operation of and the inputted upward movement of the boom 10. In addition, the second information obtaining portion 112 may obtain both of the upward operation of and the upward movement of the boom 10.

The horizontal controller portion 114 controls the horizontal control valve 41 on the basis of the information (the permission of or the non-permission of horizontalizing operation) obtained by the first information obtaining portion 111 and on the information (the upward movement and downward-moving of the boom 10) obtained by the second information obtaining portion 112.

When the start switch 100 is set to the ON position or to the ACC position and the start of the controller device 42 is executed, the horizontal controller portion 114 holds the switching valve 43 of the horizontal control valve 41 at the activating position 43*b*. For example, when the prime mover 7 is started with the start switch 100 set to the ON position, the boom 10 can be moved upward and downward by operating the operation member 105 after the starting.

Here, since the switching valve 43 of the horizontal control valve 41 is held at the activating position 43*b*, the horizontal control is automatically performed when the boom 10 is moved upward.

As described above, under the state where the boom 10 can be moved upward and downward, that is, under the state where the start switch 100 is set to the ON position, when the first information obtaining portion 111 obtains the non-permission to the horizontalizing operation and the second information obtaining portion 112 obtains the upward movement of the boom 10, the switching valve 43 of the horizontal control valve 41 is switched to the stopping position 43*a*.

That is, under the state where the horizontalizing operation is permitted, the horizontal controller portion 114 switches the horizontal control valve 41 from the activating position 43*b* to the stopping position 43*a* when the first information obtaining portion 111 obtains the non-permission and the second information obtaining portion 112 obtains the information on the upward movement of the boom 10 (the upward operation, the upward movement.

On the other hand, when the first information obtaining portion 111 does not obtain the non-permission to the horizontalizing operation under the state where the horizontalizing operation is permitted and, or when the second information obtaining portion 112 fails to obtain the upward movement of the boom 10, the horizontal controller portion 114 continues to hold the operation position 43*b* of the horizontal control valve 41.

Figure 2:
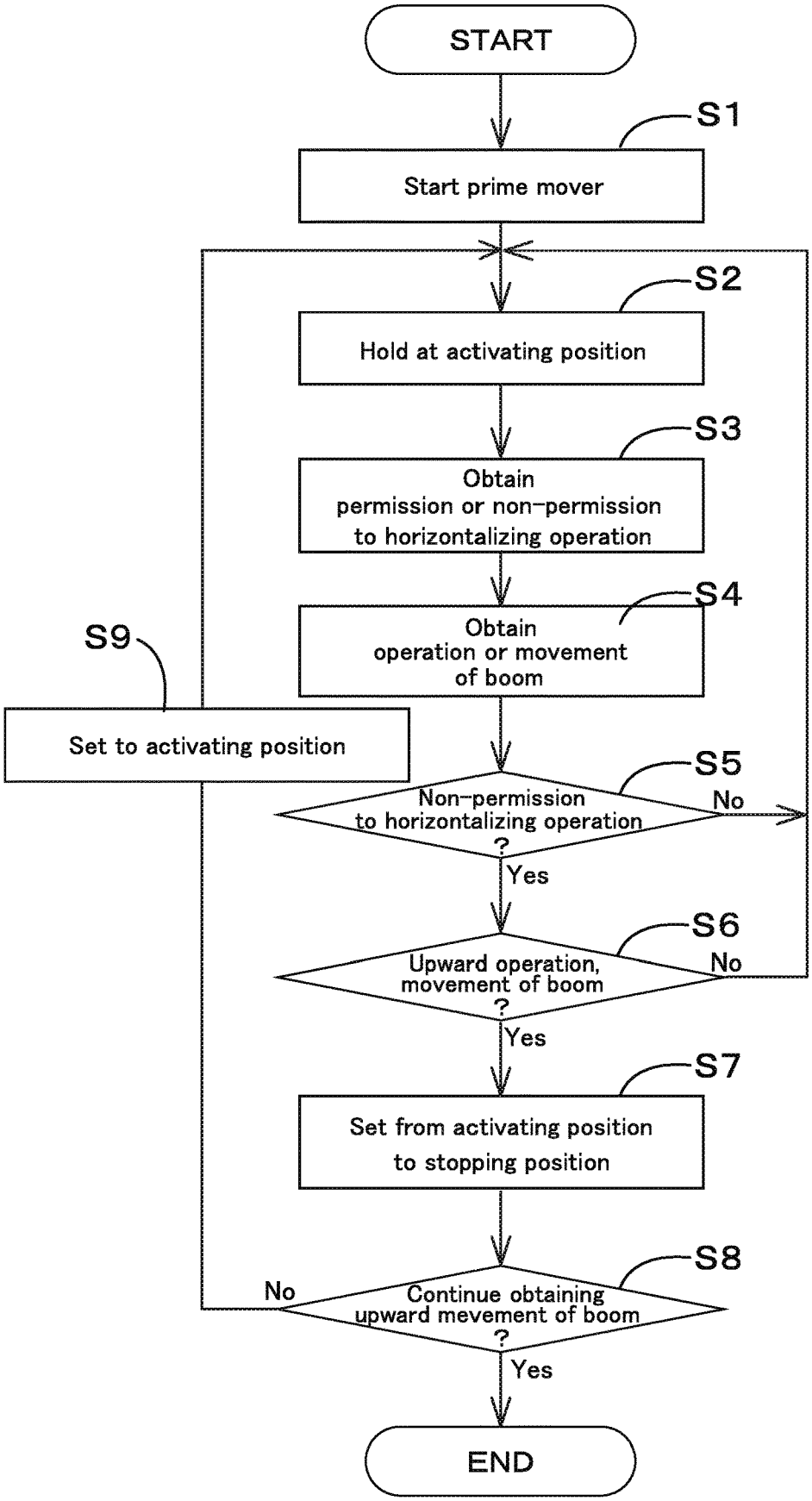
FIG. 2 is a view summarizing control to a horizontal control valve according to the first embodiment.

FIG. 2 is a diagram illustrating a flow of the horizontal control in the controller device 42 (the horizontal controller portion 114), that is, a control method of the hydraulic system for the working machine.

As shown in FIG. 2, when the start switch 100 is set to the ON position, the controller device 42 starts the prime mover 7 (step S1) in the control method of the hydraulic system for the working machine.

In addition, the controller device 42 magnetizes the solenoid of the switching valve 43 of the horizontal control valve 41 to hold the switching valve 43 of the horizontal control valve 41 at the activating position 43*b* (step S2).

The horizontal controller portion 114 obtains the permission or the non-permission to the horizontalizing operation of the horizontal control valve 41 with the first information obtaining portion 111 under the state where the switching valve 43 is held at the operation position 43*b* (step S3).

In addition, the horizontal controller portion 114 obtains any one of the operation and the movement of the boom 10 with the second information obtaining portion 112 (step S4).

The horizontal controller portion 114 judges whether the horizontalizing operation is not permitted (step S5).

When the horizontalizing operation is not permitted (step S5, Yes), the horizontal controller portion 114 judges at least whether the upward operation is performed on the boom 10 or the boom 10 is moved upward (step S6).

In other words, the horizontal controller portion 114 judges whether or not the information on the upward movement of the boom 10 (the upward operation and the upward movement) has been obtained.

When the upward operation is performed on the boom 10 or when the boom 10 moves upward (step S6, Yes), the horizontal controller portion 114 switches the horizontal control valve 41 from the position 43*b* to the stopping position 43*a* (step S7).

After switching the horizontal control valve 41 from the operation position 43*b* to the stopping position 43*a*, the horizontal controller portion 114 switches the horizontal control valve from the stopping position 43*a* to the operation position 43*b* (step S9) when the second information obtaining portion 112 stops obtaining any one of the upward operation and the upward movement (step S8, No).

The horizontal controller portion 114 returns to step S2 to continue to hold the activating position 43*b* when the horizontal controller portion 114 does not obtain that the horizontalizing operation is not permitted (step S5, No), or when the horizontal controller portion 114 does not obtain that the boom 10 is moved upward (step S6, No).

According to the above configuration, the horizontal control valve 41 is switched to the stopping position 43*a* (step S7) when the horizontalizing operation of the horizontal control valve 41 is not permitted (step S5, Yes) and when either one of the upward operation and the upward movement of the boom is obtained (step S6, Yes).

In addition, the horizontal control valve 41 is held at the activating position 43*b* (step S2) when the boom 10 is not in any one of the upward operation and the upward movement (step S5, Yes; step S6, No) under the state where the horizontalizing operation is not permitted.

In addition, after the second information obtaining portion 112 obtains either the upward operation or the upward movement of the boom 10 and switches the horizontal control valve 41 from the activating position 43*b* to the stopping position 43*a* (step S2 to step S7), the horizontal control valve 41 is switched from the stopping position 43*a* to the operation position 43*b* (step S2) when the second information obtaining portion 112 stops obtaining any one of the upward operation and the upward movement of the boom 10 (step S8, No).

When the horizontalizing operation is permitted (step S5, No), the horizontal controller portion 114 sets the horizontal control valve 41 to the activating position 43*b* regardless of the upward operation and upward movement of the boom 10.

The hydraulic system for the working machine, includes: the boom cylinder 14 to move the boom 10 upward and downward; the working tool cylinder 17 to move the working tool attached to the boom 10; the boom control valve 20A to control the boom cylinder 14; the working tool control valve 20B to control the working tool cylinder 17; the horizontal control valve 41 having: the activating position 43*b* to allow the horizontalizing operation of the working tool control valve 20B; and the stopping position 43*a* to stop the horizontalizing operation; and the controller device 42 having: the first information obtaining portion 111 to obtain permission and non-permission to the horizontalizing operation of the horizontal control valve 41; the second information obtaining portion 112 to obtain at least either one of upward operation of the boom and upward movement of the boom; and the horizontal controller portion 114 to set the horizontal control valve 41 to the stopping position 43*a* when the first information obtaining portion 111 obtains the non-permission and the second information obtaining portion 112 obtains either one of the upward operation of the boom and the upward movement of the boom.

In addition, in the control method of the hydraulic system for the working machine, the controller device 42 includes: a step for obtaining the permission and the non-permission to the horizontalizing operation of the horizontal control valve 41; and a step for setting the horizontal control valve 41 to the stopping position upon obtaining either one of an upward operation of the boom 10 and an upward movement of the boom 10 under the non-permission to the horizontalizing operation.

The control method of the hydraulic system for the working machine includes a step for holding the horizontal control valve 41 at the activating position upon having not obtained at least either one of the upward operation and the upward movement under the non-permission to the horizontalizing operation.

The control method of the hydraulic system for the working machine includes a step for setting the horizontal control valve 41 from the stopping position 43*a* to the activating position 43*b* upon finishing obtaining either one of the upward operation and the upward movement, after obtaining either one of the upward operation and the upward movement and setting the horizontal control valve 41 from the activating position to the stopping position 43*a*.

According to that configuration, the horizontalizing operation can be stopped only when the horizontalizing operation is not permitted and the boom 10 is moved upward. That is, except when the horizontalizing operation is not permitted and the boom 10 is moved upward, the pressure of the operation fluid acting on the boom cylinder 14 is not applied to both of the boom control valve 20A and the horizontal control valve 41, so that the leak amount can be suppressed. In particular, the amount of leakage caused when the boom 10 is jacked up can be reduced.

The hydraulic system for the working machine includes the start switch 100 to allow at least the controller device to be activated. The horizontal controller portion 114 holds the horizontal control valve 41 at the activating position 43*b* when the start switch 100 allows the controller device to be activated.

According to this configuration, even under the state where the horizontal control valve 41 is set to the stopping position 43*a* when the driving of the working machine is stopped, the horizontal control valve 41 is held at the activating position 43*b* when the controller device 42 is activated (when the working machine is just started up), and thereby the leak amount of leak can be suppressed just after the starting-up of the working machine.

The horizontal controller portion 114 holds the horizontal control valve 41 at the activating position 43*b* when the second information obtaining portion 112 has not obtained at least either one of the upward operation of the boom 10 and the upward movement of the boom 10 under the non-permission to the horizontalizing operation.

The horizontal controller portion 114 sets the horizontal control valve 41 from the stopping position 43*a* to the activating position 43*b* when the second information obtaining portion 112 finishes obtaining either one of the upward operation and the upward movement, after the second information obtaining portion 112 obtains either one of the upward operation and the upward movement and the horizontal control valve 41 is set from the activating position 43*b* to the stopping position 43*a*.

The horizontal controller portion 114 sets the horizontal control valve 41 to the activating position 43*b* under the permission to the horizontalizing operation regardless of the upward operation and the upward movement. In any case, since the pressure of the operation fluid acting on the boom cylinder 14 is not applied to both of the boom control valve 20A and the horizontal control valve 41, the leak amount can be suppressed.

The horizontal controller portion 114 sets the horizontal control valve 41 from the activating position 43*b* to the stopping position 43*a* when the first information obtaining portion 111 obtains the non-permission under the permission to the horizontalizing operation and the second information obtaining portion 112 obtains either one of the upward operation and the upward movement. According to this configuration, when the permission to the horizontalizing operation is changed to the non-permission, the horizontal control valve 41 can be always set to the stopping position 43*a*.

The horizontal controller portion 114 continuously holds the horizontal control valve 41 at the activating position 43*b* when the first information obtaining portion 111 has not obtained the non-permission under the permission to the horizontalizing operation and/or when the second information obtaining portion 112 has not obtained either one of the upward operation and the upward movement under the permission to the horizontalizing operation. According to this configuration, when the horizontalizing operation is not prohibited, the horizontalizing operation can be stably performed by the horizontal control valve 41.

Second Embodiment

Figure 3:
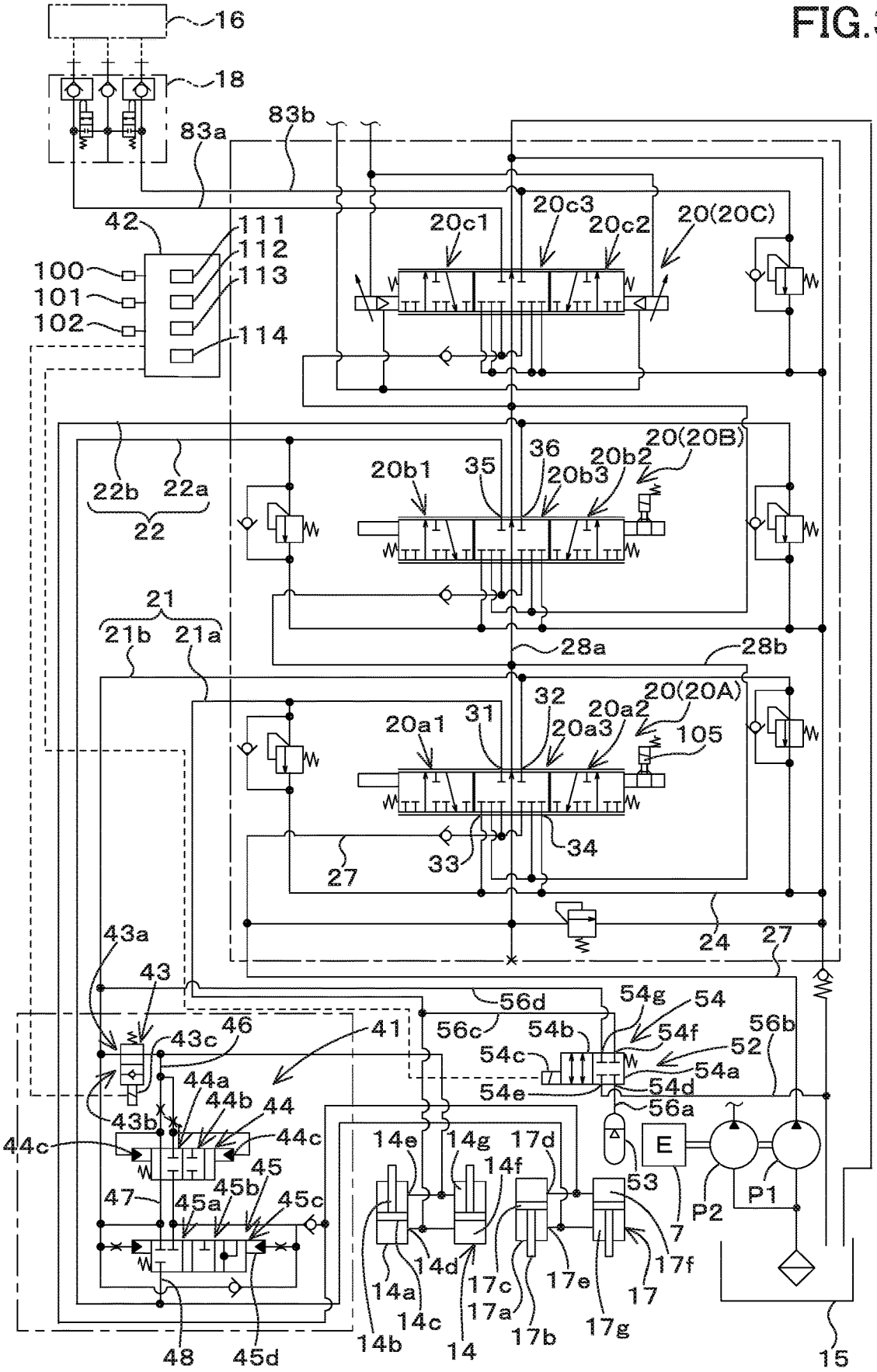
FIG. 3 is a view illustrating a hydraulic system (a hydraulic circuit) according to a second embodiment of the present invention.

FIG. 3 shows a hydraulic system for the working machine according to a second embodiment of the present invention. In the second embodiment, configurations different from those of the first embodiment will be described, and the description of the configurations same as those of the first embodiment will be omitted.

As shown in FIG. 3, the hydraulic system for the working machine includes a ride controller device 52. The ride controller device 52 is a device configured to perform the ride control of the working machine 1. The ride control is a technique for suppressing the fluctuation of the pressure of the boom cylinder 14 to suppress the traveling vibration of the working machine 1 (for performing the anti-vibration operation of the machine body 2).

More specifically, when the working machine 1 travels and then the bucket 11 vibrates up and down, a pressure fluctuation occurs in the first fluid chamber 14*f* (the fluid chamber on the bottom side) of the boom cylinder 14. The ride controller 52 suppresses the pressure fluctuation in the first fluid chamber 14*f* (absorbing with an accumulator 53 described later), thereby suppressing the traveling vibration of the working machine 1.

The ride controller device 52 has the accumulator 53 and the ride control valve 54.

The accumulator 53 is a pressure accumulator device configured to absorb the pressure fluctuation in the first fluid chamber 14*f* of the boom cylinder 14.

The ride control valve 54 is a device having a stopping state in which the operation of the ride controller device 52 is stopped (a state in which the ride control is not performed) and having an activating state in which the ride controller device 52 is activated (a state in which the ride control is performed). The ride control valve 54 is a two-position switching valve configured to be switched between a stopping position 54*a* where the ride controller device 52 is stopped and an activating position 54*b* where the ride controller device 52 is activated.

In the present embodiment, the ride control valve 54 is an electromagnetic switching valve configured to be switched to the stopping position 54*a* by a spring and switched to the activating position 54*b* by magnetizing the solenoid 54*c*. In addition, the ride control valve 54 is a four-port switching valve having a first port 54*d*, a second port 54*e*, a third port 54*f*, and a fourth port 54*g*.

The first port 54*d* is connected to the accumulator 53 by an fluid tube 56*a*. The second port 54*e* is connected to an fluid tube (a discharge fluid tube) 56*b* for discharging the operation fluid. The discharge fluid tube 56 is connected to the operation fluid tank 15. The third port 54*f* is connected to the first supply tube 21*a* through the fluid tube 56*c*.

That is, the third port 54*f* is connected to the first fluid chamber 14*f* of the boom cylinder 14 through the fluid tube 56*c* and the first supply tube 21*a*. In other words, the ride controller device 52 (the ride control valve 54) is connected to the boom cylinder 14 (the first fluid chamber 14*f*) through the fluid tube 56*c* and the first supply tube 21*a*.

The fourth port 54*g* is connected between the horizontal control valve 41 (the switching valve 43) in the first fluid tube 21 (second supply tube 21*b*) and the boom control valve 20A through a fluid tube (a third fluid tube) 56*d*. That is, the fluid tube (the third fluid tube) 56*d* has one end connected to the ride controller device 52 (the ride control valve 54) and has the other end connected to a portion between the horizontal control valve 41 in the first fluid tube 21 (the second supply tube 21*b*) and the boom control valve 20A.

In other words, the ride controller device 52 (the ride control valve 54) communicates between the horizontal control valve 41 in the first fluid tube 21 (the second supply tube 21*b*) and the boom control valve 20A. In addition, when the switching valve 43 is set to the stopping position 43*a*, the fourth port 54*g* communicates with the second fluid chamber 14*g* of the boom cylinder 14 through the fluid tube (the third fluid tube) 56*d* and the second supply tube 21*b*.

At the stopping position 54*a*, the communication between the first port 54*d* and the third port 54*f* is blocked. As the result, the communication between the boom cylinder 14 (the first fluid chamber 14*f*) and the accumulator 53 is blocked. In addition, at the stopping position 54*a*, the communication between the second port 54*e* and the fourth port 54*g* is blocked. In this manner, the communication between the fluid tube (the third fluid tube) 56*d* and the fluid tube 56*b* (the tank 15) is blocked.

Thus, when the ride control valve 54 is set to the stopping position 54*a*, the communication between the first fluid chamber 14*f* and the accumulator 53 is blocked. In this manner, the pressure fluctuation in the first fluid chamber 14*f* is not absorbed by the accumulator 53, and thus the anti-vibration operation (the ride control) by the ride controller device 52 is not performed.

At the activating position 54*b*, the first port 54*d* communicates with the third port 54*f*. In this manner, the boom cylinder 14 (the first fluid chamber 14*f*) and the accumulator 53 communicate with each other. In addition, at the activating position 54*b*, the second port 54*e* and the fourth port 54*g* communicate with each other. In this manner, the fluid tube (the third fluid tube) 56*d* communicates with the tank 15.

Thus, when the ride control valve 54 is set to the activating position 54*b* and the switching valve 43 is set to the stopping position 43*a*, the first fluid chamber 14*f* communicates with the accumulator 53, and the second fluid chamber 14*g* communicates with the tank 15. In this manner, the pressure fluctuation in the first fluid chamber 14*f* is absorbed by the accumulator 53, and the anti-vibration operation (the ride control) by the ride controller device 52 is performed.

In addition, the ride control valve 54 is arranged in the vicinity of the boom control valve 20A. In this manner, it possible to easily connect the fluid tube (the third fluid tube) 56*d* to the first fluid tube 21 (the second supply tube 21*b*).

The controller device 42 controls the horizontal control valve 41 based on the operation of the ride controller device 52. The controller device 42 is connected to a second switch 115. The second switch 115 is, for example, a switch configured to be turned ON/OFF, and is installed around the operator seat 8. The ON/OFF switching of the second switch 115 can be manually performed by the operator.

When the second switch 115 is ON, the controller device 42 is instructed to allow the anti-vibration operation, and when the first switch 101 is OFF, the controller device 42 is instructed to disallow the anti-vibration operation.

The controller device 42 includes a third information obtaining portion 113. The controller device 42 obtains the permission and the non-permission to the anti-vibration operation in the ride controller device 52. For example, when a signal indicating that the second switch 115 is ON is inputted to the controller device 42, the third information obtaining portion 113 obtains the permission to the anti-vibration operation, and when a signal indicating that the second switch 115 is OFF is inputted to the controller device 42, the third information obtaining portion 113 obtains the non-permission to the anti-vibration operation.

When the third information obtaining portion 113 obtains the permission to the anti-vibration operation, the horizontal controller portion 114 holds the horizontal control valve 41 at the stopping position 43*a*, and when the third information obtaining portion 113 obtains the non-permission to the anti-vibration operation, the horizontal control valve 41 is held at the activating position 43*b*.

In addition, the horizontal controller portion 114 switches the horizontal control valve 41 from the stopping position 43*a* to the activating position 43*b* when the first information obtaining portion 111 obtains the permission and the second information obtaining portion 112 obtains the upward movement of the boom 10 under the state where the horizontal control valve 41 is held at the stopping position 43*a*.

The horizontal controller portion 114 continues to hold the horizontal control valve 41 at the stopping position 43*a* when the first information obtaining portion 111 does not obtain the permission or the second information obtaining portion 112 does not obtain the upward movement of the boom 10 under the state where the horizontal control valve 41 is held at the stopping position 43*a*.

Figure 4:
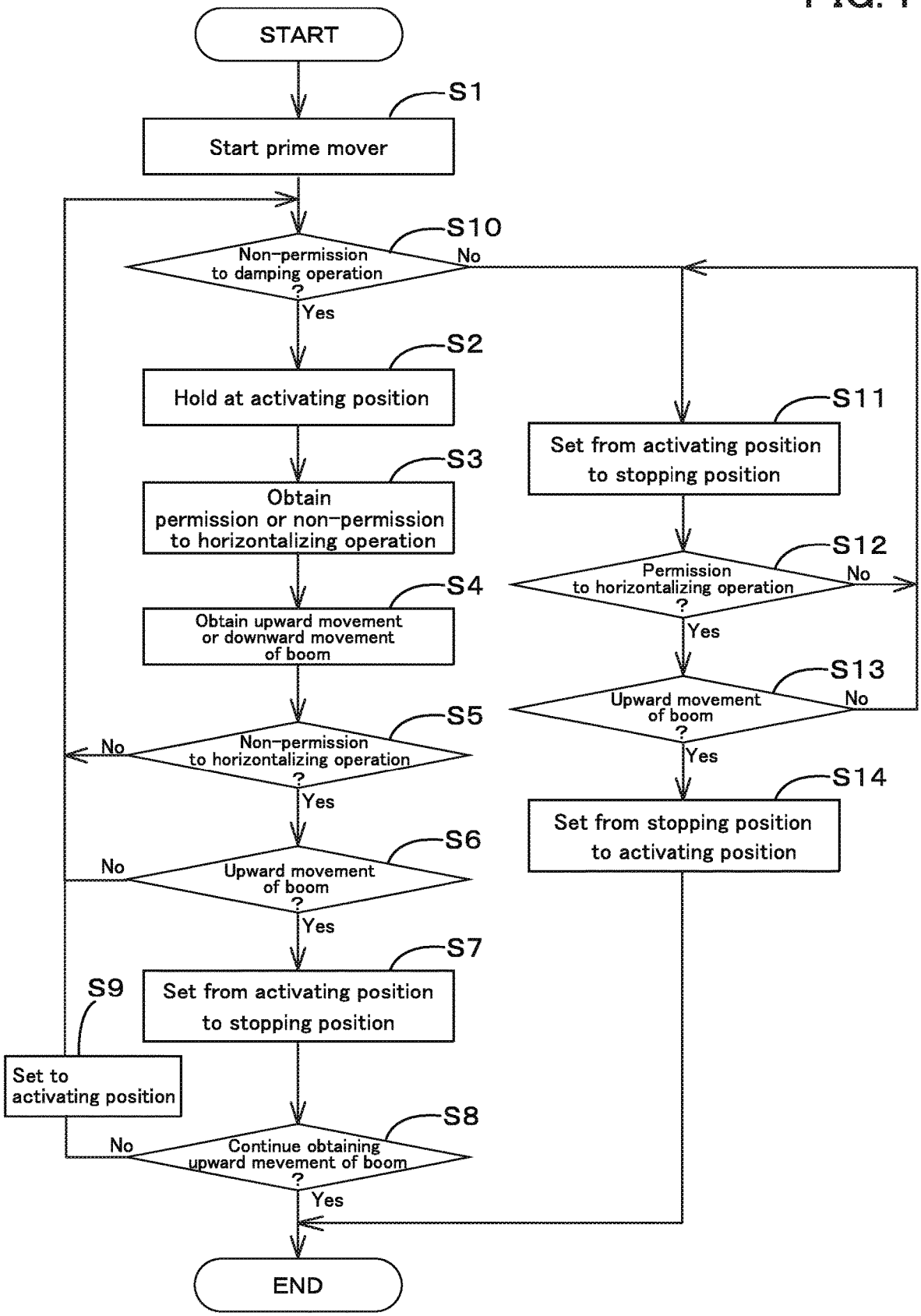
FIG. 4 is a view summarizing control to a horizontal control valve according to the second embodiment.

FIG. 4 is a diagram illustrating a flow of the horizontal control in the controller device 42 (the horizontal controller portion 114).

In FIG. 4, step S1 to step S9 are the same as the steps shown in FIG. 2. As shown in FIG. 4, when the third information obtaining portion 113 obtains the non-permission to the anti-vibration operation (step S10, Yes), the horizontal controller portion 114 proceeds to step S2 and holds the switching valve 43 of the horizontal control valve 41 at the activating position 43*b* (step S2).

On the other hand, when the third information obtaining portion 113 does not obtain the non-permission to the anti-vibration operation (step S10, No), the horizontal controller portion 114 switches the switching valve 43 of the horizontal control valve 41 from the activating position 43*b* to the stopping position 43*a* (step S11).

The horizontal controller portion 114 judges whether the horizontalizing operation is permitted (step S12). When the horizontalizing operation is permitted (step S12, Yes), the horizontal controller portion 114 judges whether the boom 10 is moving upward (step S13).

When the boom 10 is moving upward (step S13, Yes), the horizontal controller portion 114 switches the switching valve 43 of the horizontal control valve 41 from the stopping position 43*a* to the activating position 43*b* (step S14).

In addition, when the horizontal controller portion 114 has not obtained that the horizontalizing operation is permitted (step S12, No) or has not obtained that the boom 10 is moving upward (step S13, No), the horizontal controller portion 114 proceeds to step S11 and continues to hold the stopping position 43*a*.

The hydraulic system for the working machine includes the ride controller device 52 to perform the damping operation (the anti-vibration operation) to suppress the pressure fluctuation of the boom cylinder 14. The controller device 42 has the third information obtaining portion 113 to obtain the permission and the non-permission to the damping operation of the ride controller device 52. The horizontal controller portion 114 holds the horizontal control valve 41 at the stopping position 43*a* when the third information obtaining portion 113 obtains the permission of the damping operation, and holds the horizontal control valve 41 at the activating position 43*b* when the third information obtaining portion 113 obtains the non-permission of the damping operation.

According to this configuration, when the anti-vibration operation is not performed, the horizontal control valve 41 can be reliably held at the activating position 43*b*.

Figure 5:
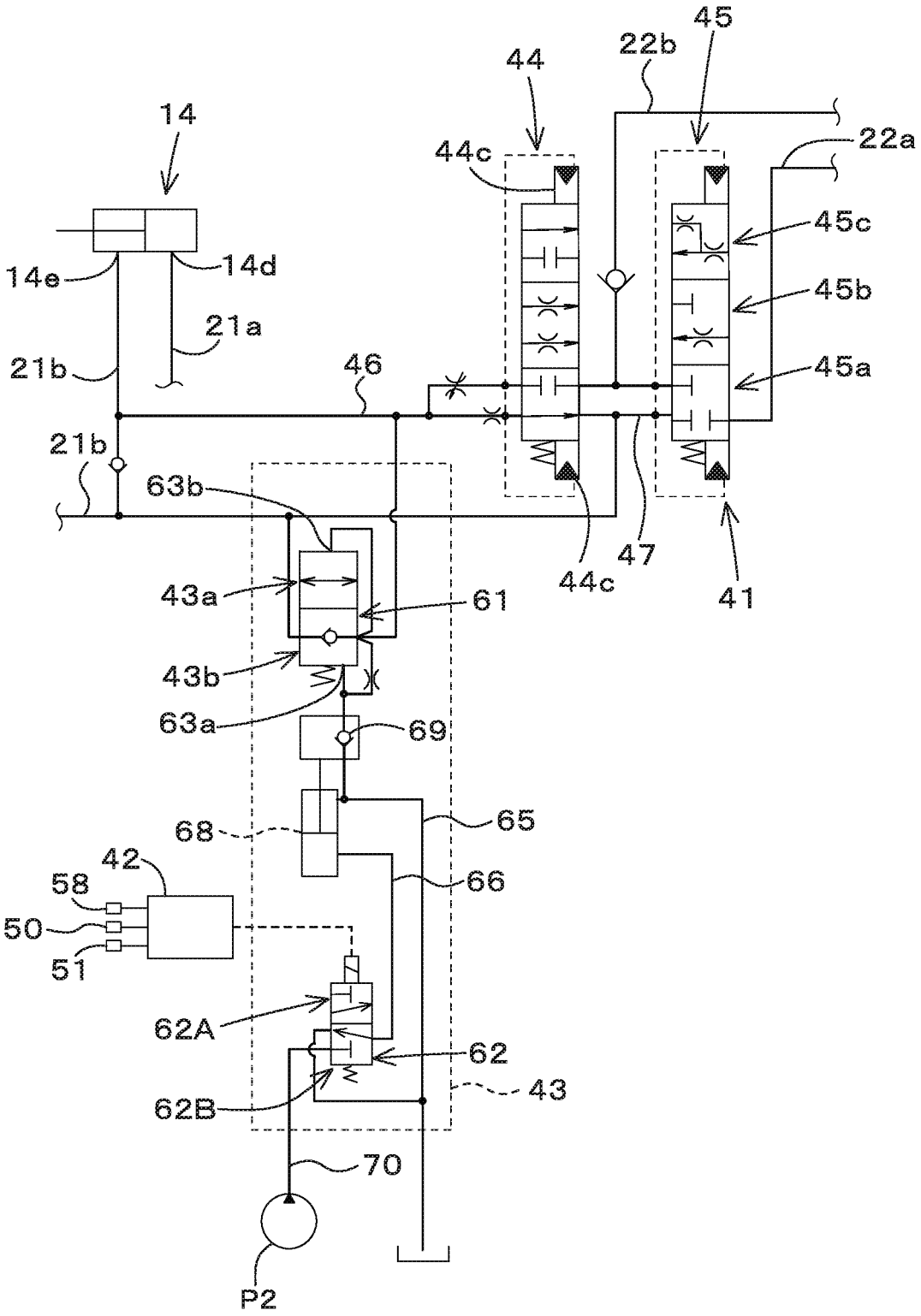
FIG. 5 is a view illustrating a horizontal control valve according to a modified example of the embodiments.

FIG. 5 shows a modified example of the horizontal control valve 41. The horizontal control valve 41 according to the modified example is applicable to both of the first embodiment and the second embodiment. In FIG. 5, the configurations same as those of the above-described embodiments are denoted by the same reference numerals, and the description thereof will be omitted.

As shown in FIG. 5, the horizontal control valve 41 includes the switching valve 43, the first control valve 44, and the second control valve 45. The switching valve 43 is configured to be switched between the stopping position 43*a* and the activating position 43*b*. The switching valve 43 includes the first operating valve 61 and the second operating valve 62.

When the pilot pressure applied to the pressure receiving portion 63*a* and the pressure receiving portion 63*b* on the side opposite to the pressure receiving portion 63*a* become to have the same pressure, the first operating valve 61 is switched to the activating position 43*b*, and when the pressure of the pressure receiving portion 63*b* is changed to be higher than the pressure receiving portion 63*a*, the first operating valve 61 is switched to the stopping position 43*a*.

The second operating valve 62 is an electromagnetic valve configured to switch the first operating valve 61. The second operating valve 62 is switched to the first position 62A when the solenoid 62C is magnetized, and is switched to the second position 62B when the solenoid is demagnetized. The pilot pressure is applied to the second operating valve 62 through a fluid tube (not shown in the drawings).

The controller device 42 performs the switching of the second operation valve 62. A switching actuator 68 is connected between the first operating valve 61 and the second operating valve 62 through the fluid tubes 65 and 66. The fluid tube 65 connects the pressure receiving portion 63*a* of the second operating valve 62, a switching actuator 68 such as a hydraulic cylinder, and the second operating valve 62, and has a middle portion connected to a check valve 69. The fluid tube 66 connects the switching actuator 68 and the second operating valve 62.

Thus, when the second operating valve 62 is switched to the first position 62A, the pilot pressure from the second operating valve 62 is applied to the fluid tube 66. In this manner, the switching actuator 68 is stretched, and the pressure of the pressure receiving portion 63*a* of the first operating valve 61 decreases through the check valve 69.

On the other hand, when the second operating valve 62 is switched to the second position 62B, the pilot pressure acting on the bottom side of the switching actuator 68 is discharged to the operation fluid tank and the like through the discharge fluid tube 70 connected to the fluid tube 66 and the second operating valve 62. In this manner, the switching actuator 68 is shortened, and thus the pressure receiving portion 63*a* of the first operating valve 61 and the pressure receiving portion 63*b* become to have the same pressure.

Figure 6A:
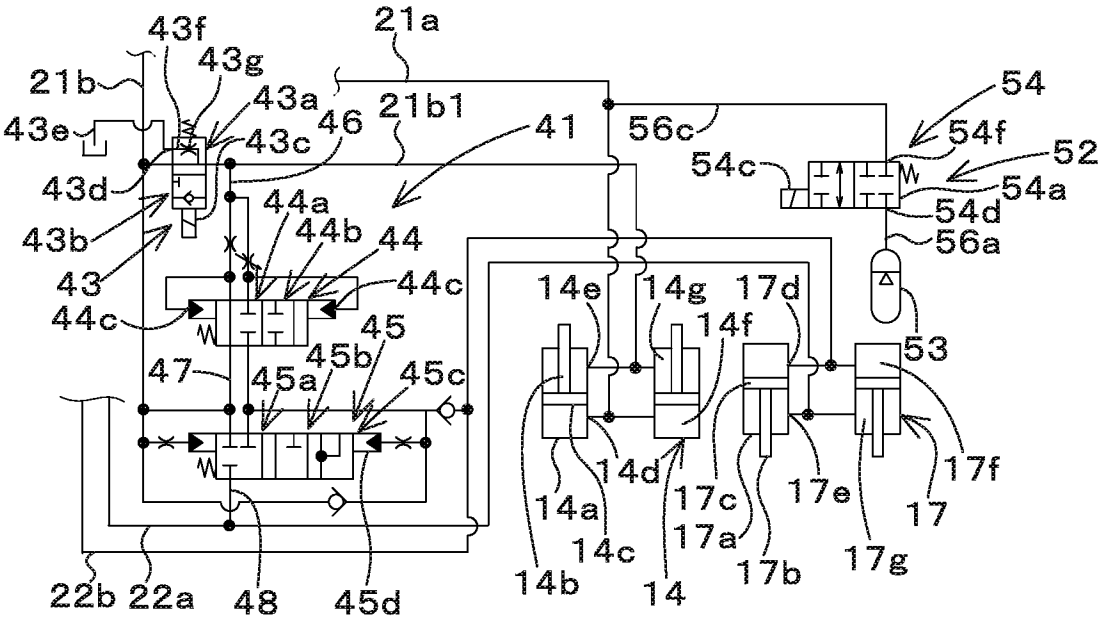
FIG. 6A is a view illustrating a horizontal control valve and a ride control valve according to a modified example of the embodiments.

FIG. 6A shows a modified examples of the horizontal control valve 41 and the ride control valve 54.

As shown in FIG. 6A, the second port 54*e*, the third port 54*f*, and the fourth port 54*g* of the ride control valve 54 are not connected to the fluid tube, and the first port 54*d* and the third port 54*f* communicate with each other when the horizontal control valve 41 is set to the activating position 54*b*. The switching valve 43 includes a discharge port 43*d* configured to communicate with the discharge fluid tube 43*e* when the horizontal control valve 41 is set to the stopping position 43*a*. The discharge port 43*d* is connected to a fluid tube (an internal fluid tube) 43*f* provided inside the switching valve 43.

The fluid tube 43*f* is connected to a section 21*b*1 of the second supply tube 21*b* that passes through the switching valve 43 and communicates with the second port 14*e* of the boom cylinder 14. In addition, the fluid tube 43*f* is provided with a throttle portion 43*g*.

Figure 6B:
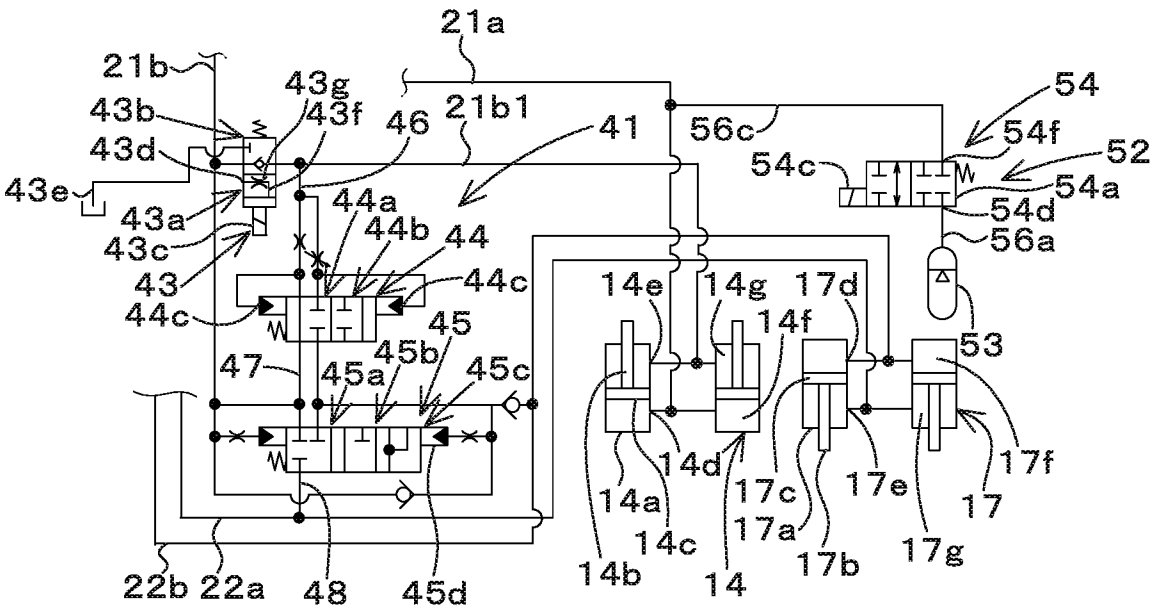
FIG. 6B is a view illustrating a horizontal control valve and a ride control valve according to a modified example of FIG. 6A.

In addition, as shown in FIG. 6B, the switching valve 43 may be a valve configured to switch to the stopping position 43*a* when the solenoid 43*c* of the switching valve 43 is magnetized and to switch to the activating position 43*b* when the solenoid 43*c* is demagnetized.

The hydraulic system for the working machine, includes: the boom cylinder 14 to move the boom 10 upward and downward; the working tool cylinder 17 to move the working tool attached to the boom 10; the boom control valve 20A to control the boom cylinder 14; the working tool control valve 20B to control the working tool cylinder 17; the horizontal control valve 41 having: the activating position 43*b* to allow the horizontalizing operation of the working tool control valve 20B; and the stopping position 43*a* to stop the horizontalizing operation; and the ride controller device 52 to perform the damping operation (the anti-vibration operation) to suppress the pressure fluctuation of the boom cylinder 14. The horizontal controller portion 114 holds the horizontal control valve 41 at the stopping position 43*a* when the damping operation is permitted, and holds the horizontal control valve 41 at the activating position 43*b* when the damping operation is not permitted.

When the horizontalizing operation is permitted and the boom 10 is moving upward under the state where the horizontal control valve 41 held at the stopping position 43*a*, the horizontal control valve 41 can be switched from the stopping position 43*a* to the activating position 43*b*.

When the horizontalizing operation is not permitted or the boom 10 is not moving upward under the state where the horizontal control valve 41 is held at the stopping position 43*a*, the horizontal control valve 41 can be held at the stopping position 43*a*.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

In the above-described embodiments, the operation fluid is discharged to the operation fluid tank, but may be discharged to another location. That is, the fluid tube for discharging the operation fluid may be connected to a portion other than the operation fluid tank, and may be, for example, connected to a suction portion of a hydraulic pump (a portion from which the operation fluid is sucked) or to another portion.

What is claimed is:

1. A hydraulic system for a working machine, comprising:

a boom cylinder to move a boom upward and downward;

a working tool cylinder to move a working tool attached to the boom;

a boom control valve to control the boom cylinder;

a working tool control valve to control the working tool cylinder;

a horizontal control valve including a switching valve having:

an activating position to allow a horizontalizing operation of the working tool; and a stopping position to stop the horizontalizing operation; and a controller device having:

a first information obtaining portion to obtain permission and non-permission to the horizontalizing operation by the horizontal control valve;

a second information obtaining portion to obtain at least either one of upward operation of the boom and upward movement of the boom; and a horizontal controller to set the switching valve from the activating position to the stopping position when the first information obtaining portion obtains the non-permission and the second information obtaining portion obtains either one of the upward operation of the boom and the upward movement of the boom, wherein the horizontal controller holds the switching valve at the activating position when the first information obtaining portion has obtained the non-permission and the second information obtaining portion has not obtained at least either one of the upward operation of the boom and the upward movement of the boom.

2. The hydraulic system according to claim 1, comprising a start switch to allow at least the controller device to be activated, wherein the horizontal controller holds the switching valve at the activating position when the start switch allows the controller device to be activated.

3. A control method of a hydraulic system for a working machine including: a boom cylinder to move a boom upward and downward; a working tool cylinder to move a working tool attached to the boom; a boom control valve to control the boom cylinder; a working tool control valve to control the working tool cylinder; a horizontal control valve including a switching valve having an activating position to allow a horizontalizing operation of the working tool and a stopping position to stop the horizontalizing operation; and a controller device to control the horizontal control valve, comprising:

obtaining permission and non-permission to a horizontalizing operation by the horizontal control valve;

setting the switching valve from the activating position to the stopping position upon obtaining either one of an upward operation of the boom and an upward movement of the boom under the non-permission to the horizontalizing operation; and holding the switching valve at the activating position upon having not obtained at least either one of the upward operation and the upward movement under the non-permission to the horizontalizing operation.

4. The hydraulic system according to claim 1, wherein the horizontal controller sets the switching valve from the stopping position to the activating position when the second information obtaining portion finishes obtaining either one of the upward operation and the upward movement, after the second information obtaining portion obtains either one of the upward operation and the upward movement and the switching valve is set from the activating position to the stopping position.

5. The hydraulic system according to claim 1, wherein the horizontal controller sets the switching valve to the activating position under the permission to the horizontalizing operation regardless of the upward operation and the upward movement.

6. The hydraulic system according to claim 1, wherein the horizontal controller sets the switching valve from the activating position to the stopping position when the first information obtaining portion obtains the non-permission and the second information obtaining portion obtains either one of the upward operation and the upward movement under the permission to the horizontalizing operation.

7. The hydraulic system according to claim 1, wherein the horizontal controller continuously holds the switching valve at the activating position when the first information obtaining portion has not obtained the non-permission under the permission to the horizontalizing operation and/or when the second information obtaining portion has not obtained either one of the upward operation and the upward movement under the permission to the horizontalizing operation.

8. The hydraulic system according to claim 1, comprising a ride controller device to perform a damping operation to suppress pressure fluctuation of the boom cylinder, wherein the controller device has a third information obtaining portion to obtain permission and non-permission to the damping operation of the ride controller device, and wherein the horizontal controller holds the switching valve at the stopping position when the third information obtaining portion obtains the permission of the damping operation, and holds the switching valve at the activating position when the third information obtaining portion obtains the non-permission of the damping operation.

9. The control method according to claim 3, comprising setting the switching valve from the stopping position to the activating position upon finishing obtaining either one of the upward operation and the upward movement, after obtaining either one of the upward operation and the upward movement and setting the switching valve from the activating position to the stopping position.

10. The hydraulic system according to claim 2, wherein the horizontal controller sets the switching valve from the stopping position to the activating position when the second information obtaining portion finishes obtaining either one of the upward operation and the upward movement, after the second information obtaining portion obtains either one of the upward operation and the upward movement and the switching valve is set from the activating position to the stopping position.

11. The hydraulic system according to claim 4, wherein the horizontal controller sets the switching valve from the activating position to the stopping position when the first information obtaining portion obtains the non-permission and the second information obtaining portion obtains either one of the upward operation and the upward movement under the permission to the horizontalizing operation.

12. The hydraulic system according to claim 2, wherein the horizontal controller sets the switching valve to the activating position under the permission to the horizontalizing operation regardless of the upward operation and the upward movement.

13. The hydraulic system according to claim 2, wherein the horizontal controller sets the switching valve from the activating position to the stopping position when the first information obtaining portion obtains the non-permission and the second information obtaining portion obtains either one of the upward operation and the upward movement under the permission to the horizontalizing operation.

14. The hydraulic system according to claim 4, wherein the horizontal controller sets the switching valve to the activating position under the permission to the horizontalizing operation regardless of the upward operation and the upward movement.

* * * * *